United States Patent [19]

Nelen

[11] Patent Number: 4,498,758

[45] Date of Patent: Feb. 12, 1985

[54] APPARATUS FOR TRANSFERRING XEROGRAPHIC IMAGES

[75] Inventor: Petrus R. Nelen, Essen, Belgium

[73] Assignee: Agfa-Gevaert N.V., Mortsel, Belgium

[21] Appl. No.: 498,157

[22] Filed: May 25, 1983

[30] Foreign Application Priority Data

May 26, 1982 [GB] United Kingdom ..... 8215317

[51] Int. Cl.[3] ..... G03G 15/00

[52] U.S. Cl. ..... 355/3 TR; 355/3 R; 101/DIG. 13

[58] Field of Search ..... 355/3 R, 16, 3 SH, 11, 355/64–66, 8, 3 TR, 72–74, 14 R; 101/DIG. 13

[56] References Cited

U.S. PATENT DOCUMENTS 3,920,326 11/1975 Hirth ..... 355/66 X 4,402,592 9/1983 Schön et al. ..... 355/3 R

*Primary Examiner*—R. L. Moses

*Attorney, Agent, or Firm*—William J. Daniel

[57] ABSTRACT

Apparatus for transferring xerographic images from one element surface to another while the elements are advanced synchronously through an image transfer station.

One element is supported on a drum and the other is supported on a carriage that is arranged for tangential displacement along the drum periphery and the carriage is driven from the drum by a flexible tie member that is angularly wound on the drum during its rotation, and is engaged at its free end to said drum. Such engagement is preferably detachable to permit independent driving of the carriage except during the image transfer operation and re-engagement is preferably accomplished automatically at the beginning of the image transfer operation.

17 Claims, 10 Drawing Figures

APPARATUS FOR TRANSFERRING XEROGRAPHIC IMAGES

Figure 1:
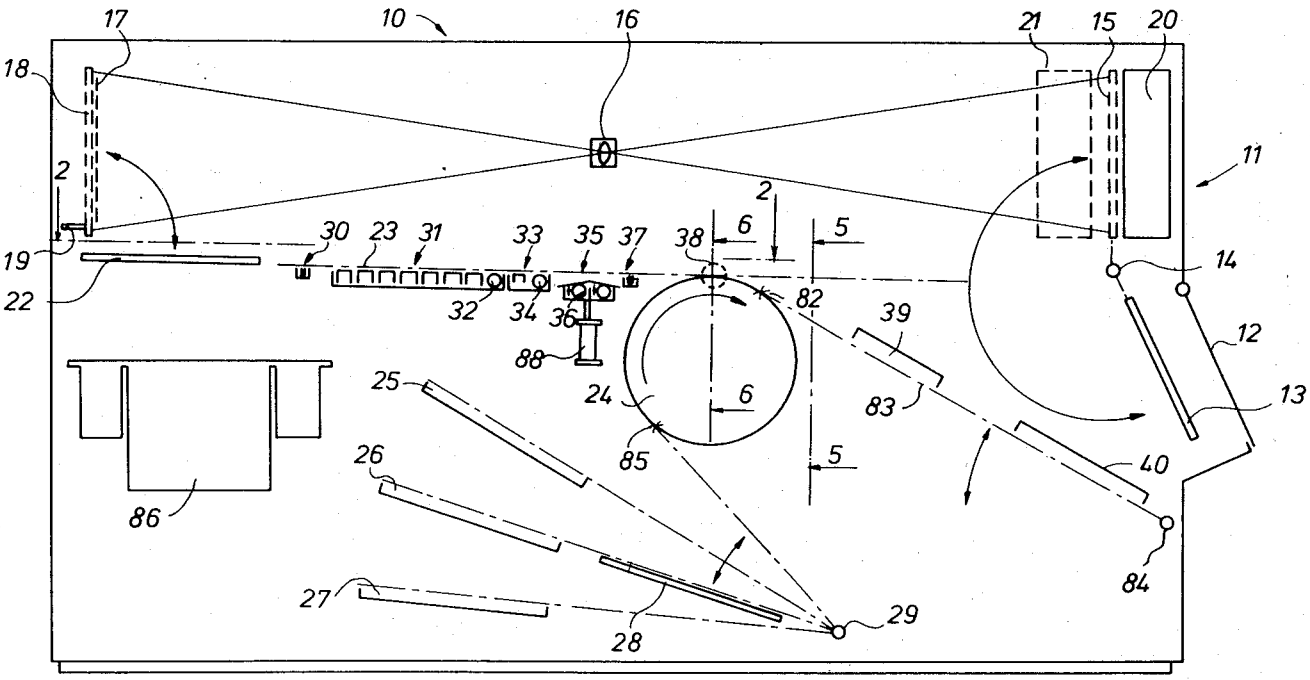

Various reprographic processes involve progressive image transfer to or from a cylindrically curved surface rotating about its axis of curvature. Such transfer may take place from or to a flat surface in tangential relationship to such curved surface or from or to a second cylindrically curved surface rotating about its axis of curvature synchronously with the first one.

Such an image transfer procedure occurs for example in rotary offset printing machines. Another well known application of such an image transfer procedure is in xerographic document copiers in which an electrostatic image is formed on a photoconductive layer on the surface of a drum and developing toner applied to the drum is transferred under the influence of an electrical field to plain receptor sheets.

In the known processes the progressive image transfer takes place during rolling contact between the surfaces which respectively donate and receive the image (see e.g. U.S. Pat. No. 3,071,070 and UK Patent Application No. GB 2,003,090 A, which latter specification relates both to offset duplicating and to xerographic printers).

For the production of high fidelity transfer images it is essential for the image-donating and image-receiving surfaces to move synchronously at the same speed through the zone where the transfer takes place.

In some apparatus, in which co-operating rolls or a roll and a carriage moving linearly in tangential relationship to the roll afford supports for the image-donating and image-receiving elements, the synchronisation is achieved by an intermeshing gear mechanism, e.g. by rack-and-pinion or planetary gearing. Such mechanisms if they are to effect a very precise, positive coupling between the supports, are expensive. Moreover if they are employed for coupling a rotating drum to a linearly moving carriage the use of such a gear coupling requires the movement range of the carriage relative to the drum to be more limited than would sometimes be desirable.

In other known apparatus the co-ordinated movements of the image-donating and image-receiving surfaces through the transfer zone is achieved simply by inter-surface frictional contact under rolling pressure. This frictional contact is relief upon for example in well known office document copiers in which plain paper receptor sheets pass between the photoconductive surface of a drum and a co-operating pressure roller. The same friction drive principle is employed in the apparatus described in the aforesaid U.S. Pat. No. 3,071,070 for transferring a toner developer xerographic image from a photoconductor sheet to a metal receptor sheet attached to the surface of a rotating drum, for the purpose of making a planographic printing plate.

Direct drive of a receptor sheet or an image-donating sheet through the image transfer station by surface friction between the sheet and a rotating cylindrically curved surface requires a certain minimum surface contact pressure to be maintained in order to avoid sheet slippage. This fact limits the usefulness of this friction drive principle in the field of xerography. The need for the rolling contact pressure restricts the choice of materials for the image-donating and image-receiving surfaces. For example when toner images have to be transferred to image-receiving sheets from a photoconductive element, the receptor sheets must be composed so that they do not cause damage to the photoconductive surface, which is usually not very resistant to mechanical damage. In plain paper copiers, no problems normally arise, the receptor sheets being smooth and light in weight. However for making transfer copies on certain metal receptor sheets the necessary contact pressure would be liable to damage the photoconductive element. For example, sheets of uncoated anodised aluminium as used in the production of planographic printing plates have a rough aluminium oxide surface which provides minute pores or recesses for toner particle retention and the surface is somewhat abrasive. The necessity for firm rolling contact pressure between the image-donating and image-receiving surfaces also restricts the choice of toner. Such pressure is not an appropriate condition forthe transfer of liquid toner, whether a pure liquid or a dispersion of toner particles in a liquid carrier.

It is an object of the present invention to provide an apparatus for use in transferring xerographic toner images from one element to another, wherein the movements of rotating and linearly moving supports for such elements are synchronised without reliance on surface contact pressure or on intermeshing gear coupling between these supports.

According to the invention, an apparatus compromises a carriage and a rotatable member for supporting elements between which toner transfer is to take place and which are connected by a flexible tie. During rotation of the rotatable member such tie winds onto a surface thereof having a radius of curvature such that the tie pulls the carriage past the toner transfer station at a linear speed substantially equal to that of the periphery of said rotatable member.

The invention affords various advantages. The movement of the carriage past the transfer station is made continuously dependent on and is synchronised with the rotation of the rotatable member in a simple and reliable way. The need for expensive gearing manufactured to close tolerances is obviated.

Should there be a momentary departure from true synchronisation during said carriage movement, caused e.g. by some local imperfection in the winding surface for the flexible tie, such fault will always occur at the same point along the carriage path in repetitive cycles of the apparatus. This is of importance e.g. in the production of plural colour transfer images by forming colour separation transfer images and printing these in registration. Localised unsharpness of separation images are much less noticeable when they occur at the same positions than when they occur at different positions in the plural colour images.

Apparatus according to the invention can be used in the transfer of toner images from a photoconductive element or from a non-photoconductive electrostatically chargeable element. The invention has been made primarily to provide for improved manufacture of lithographic printing plates, but the apparatus can be used for the production of high-grade reproductions on plain paper, plastics or other supports. The apparatus can be used in the transfer of liquid toner, by which is meant a toner which a true liquid or a toner comprising toner particles suspended in a liquid carrier, or in the transfer of dry toner.

The cylindrically curved periphery of the rotatable member, for supporting an image-receiving or image-donating element, may subtend 360° but this is not essential. The surface can subtend a smaller angle.

The rotatable member can carry a photoconductive or non-photoconductive dielectric element in the form of a layer formed on the cylindrically curved periphery of such member. Preferably however, such rotatable member has means for releasably holding a flexible sheet against such periphery. In that case the apparatus can advantageously be used for transfering a toner image from a photoconductor sheet held by the carriage to a receptor sheet e.g. a metal receptor sheet, releasably held by the rotatable member.

A very advantageous form of rotatable sheet supporting member, which can be used in apparatus according to the invention, comprises segmental components which are relatively peripherally displaceable for enabling flexible sheets of different sizes to be held against the periphery of the member, is described in co-pending European Patent Application No. 83 200 310.7 filed on Mar. 4, 1983.

The movement of the carriage past the image transfer station is not in any way dependent on contact pressure between image-donating and image-receiving surfaces. The line of motion of the carriage past the transfer station can be such that these surfaces just make contact with each other at the transfer station, or are even slightly spaced apart at that station. Apparatus which is constructed or which is adjusted so that such surface spacing occurs is very suitable for effecting liquid toner image transfer from a photoconductor surface to the surface of a metal receptor sheet. For transferring a liquid toner image it is suitable for example for there to be a gap of between 10 and 100 microns between the two surfaces at the transfer station.

In order to ensure the required speed synchronisation the distance over which the carriage is pulled via the tie member should correspond with less than one complete revolution of the rotatable member so that the flexible tie does not have to wind on itself. For extreme accuracy of speed synchronisation the arc to which the neutral or central plane of the winding portion of the tie member conforms when it is wound onto the rotatable member should have the same radius as the image-donating or image-receiving surface of the element supported on the periphery of said rotatable member.

The winding surface onto which the flexible tie member winds as the carriage is pulled past the image transfer station, and the cylindrically curved periphery for supporting an image-donating or image-receiving element, can be one and the same, because the flexible tie member can wind onto a part of that surface which is alongside its element-supporting region. Alternatively the winding surface can be provided by a part distinct from that which bears the image-receiving or image-donating element. For example the winding surface can be the peripheral surface of a disc or sector plate of sufficient thickness to support the tie member. The two distinct parts can be integral parts of a common structure, or they can be separate components which are interconnected, e.g. by being keyed to a common shaft. For the purposes of this specificiation such interconnected parts are regarded as parts of what is referred to as "the rotatable member".

In preferred apparatus according to the invention, the tie member is detachable from the rotatable member and means are present for mechanically driving the carriage along its track towards the rotatable member, preparatory to being coupled to the rotatable member by the tie member. It is very advantageous for the overall length of the carriage track to exceed the distance over which the carriage is pulledpast the transfer station by the flexible tie. During movement over the additional, adjoining part of the track an element held by the carriage can be subjected to preparatory treatment. Preferably the apparatus forms part of a machine which includes means for applying developing toner to a sheet-like element held by the carriage, while the carriage is being driven along the track preparatory to being pulled past the transfer station by means of the tie member. The coupling of the carriage to the rotatable member by means of the tie member preferably occurs automatically. This can be achieved by providing the flexible tie member and the rotatable member with coupling means which inter-engage as the carriage is brought to a predetermined position along the track.

A suitable form of tie member, comprising a leaf spring, and a suitable form of coupling, which is simple and reliable and requires no maintenance, are described hereinafter. The coupling can easily be automatically released, as hereafter described, after the carriage has been pulled past the transfer station.

The carriage is preferably supported by the carriage track on air bearings. Such bearings enable the carriage to move extremely smoothly, without any vibration.

Figure 2:
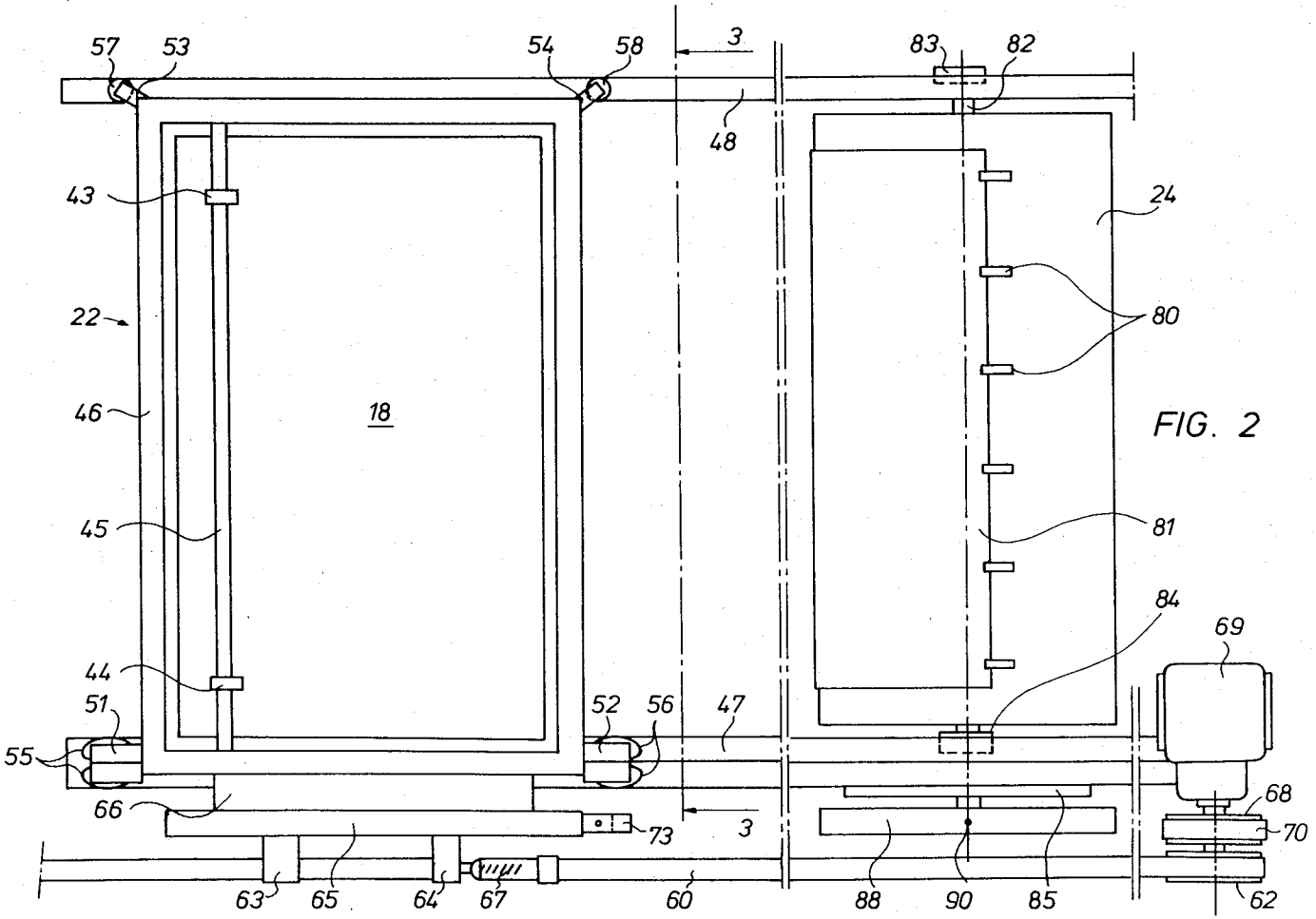
Figure 3:
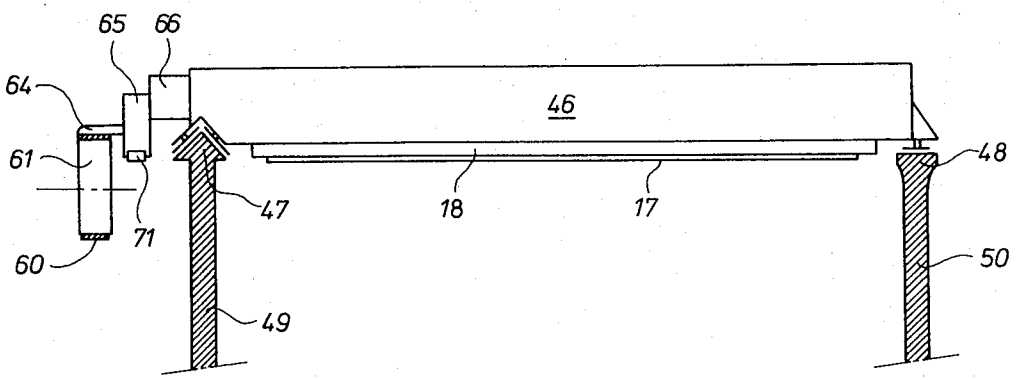
Figure 4:
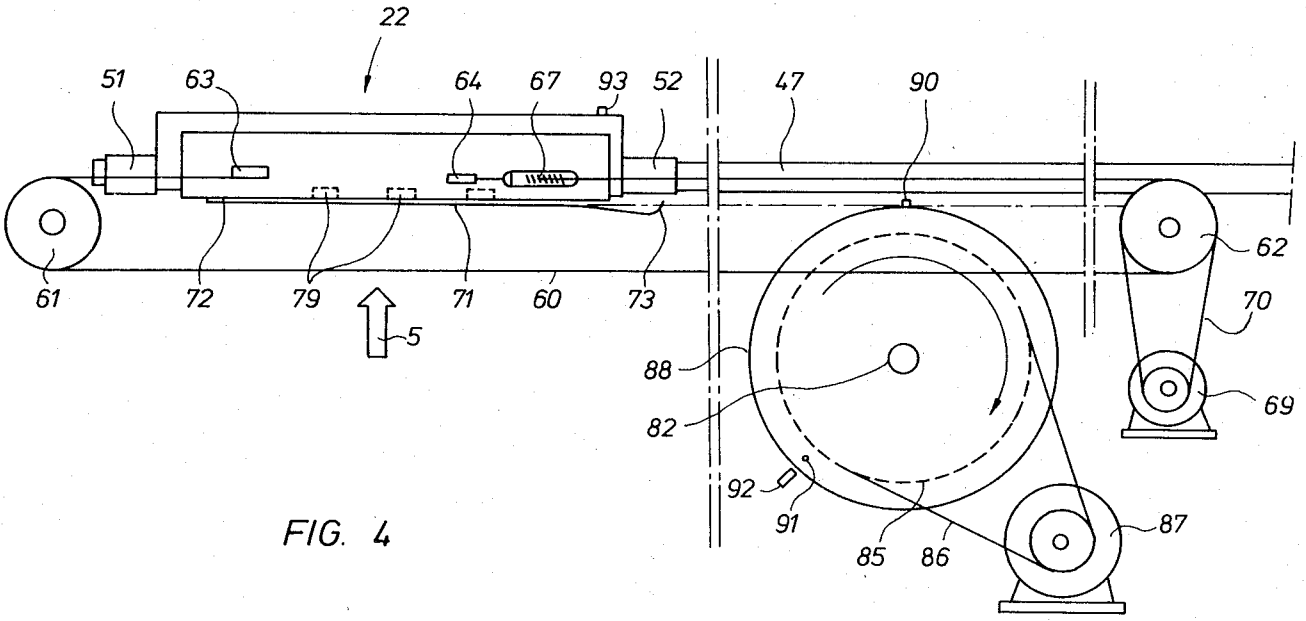
Figure 6:
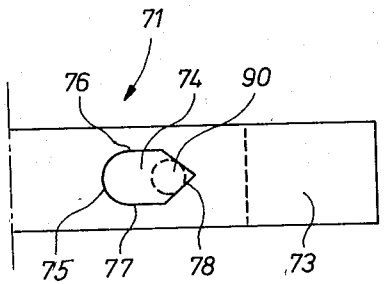
Figure 5:
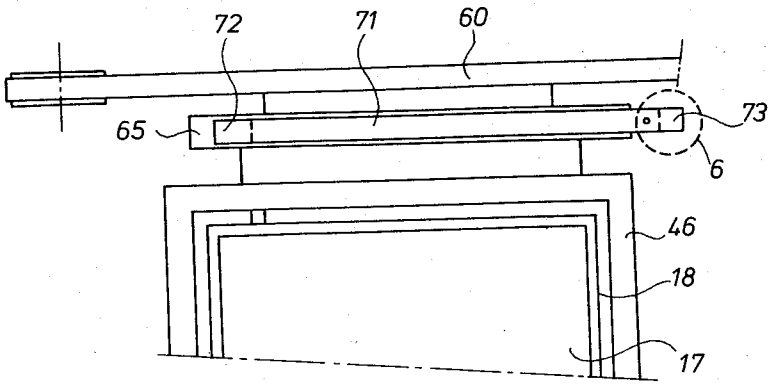
Figure 8:
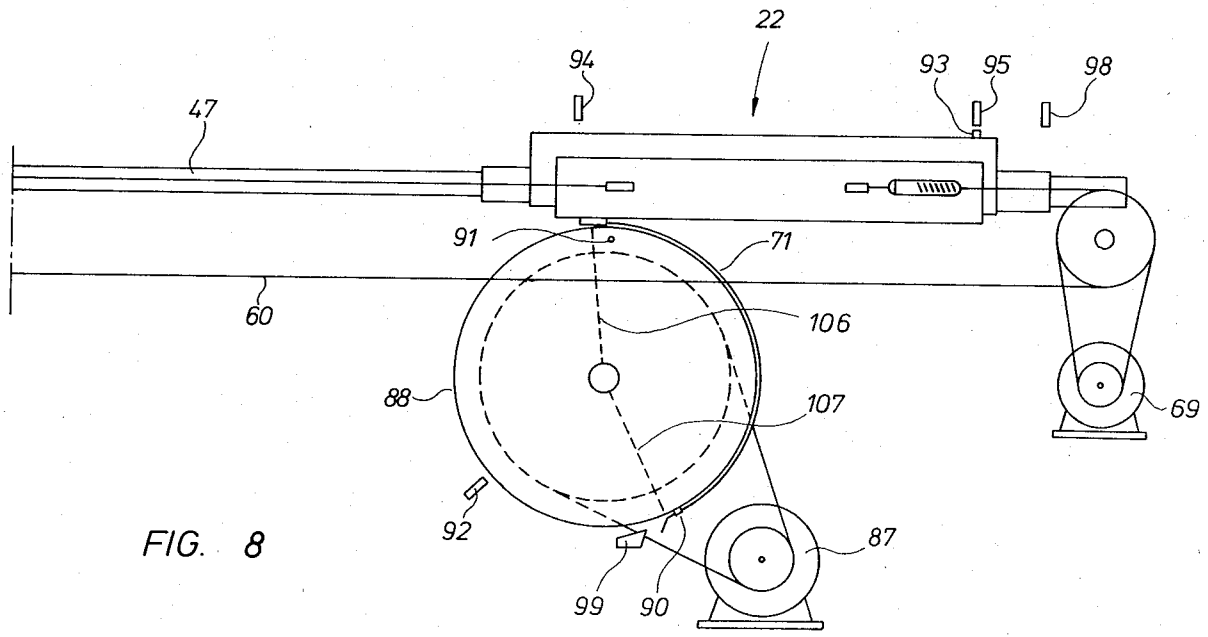
Figure 9:
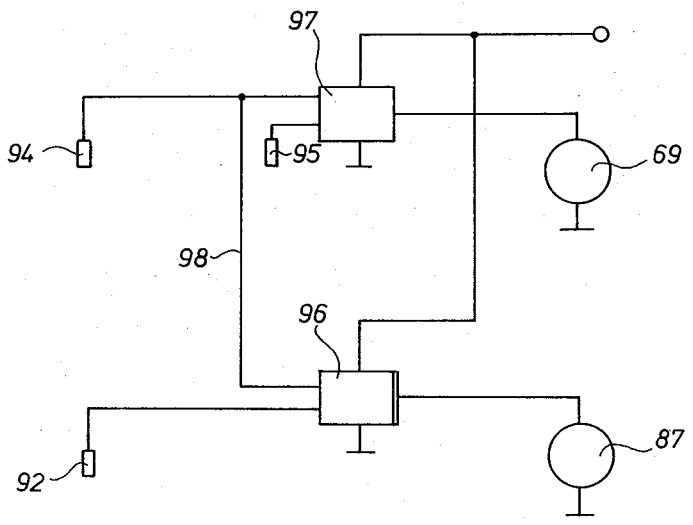

An embodiment of the invention selected by way of example, will now be described with reference to the accompanying drawings, wherein:

FIG. 1 is a diagrammatic longitudinal sectional view through one embodiment of an apparatus according to the invention, FIG. 2 is a plan view on an enlarged scale, on line 2—2 of FIG. 1 of the rotatable member and the linearly movable member, FIG. 3 is a transverse sectional view of the apparatus on line 3—3 of FIG. 2, FIG. 4 is a lateral view of the apparatus illustrating the driving of the movable members of the apparatus, FIG. 5 is a bottom view of the leaf spring mounted on the carriage of the apparatus, looking in the direction of the arrow 5 of FIG. 4, FIG. 6 is an enlarged view of the portion 6 of FIG. 5, FIG. 7 is a lateral view of the apparatus immediately after coupling of the leaf spring carriage with the drum, FIG. 8 is a lateral view of the apparatus, the leaf spring being completely wound on the drum, and the carriage having reached the end of the toner transfer zone, and FIG. 9 is a block diagram of the electronic control system for the driving motor.

Figure 10:
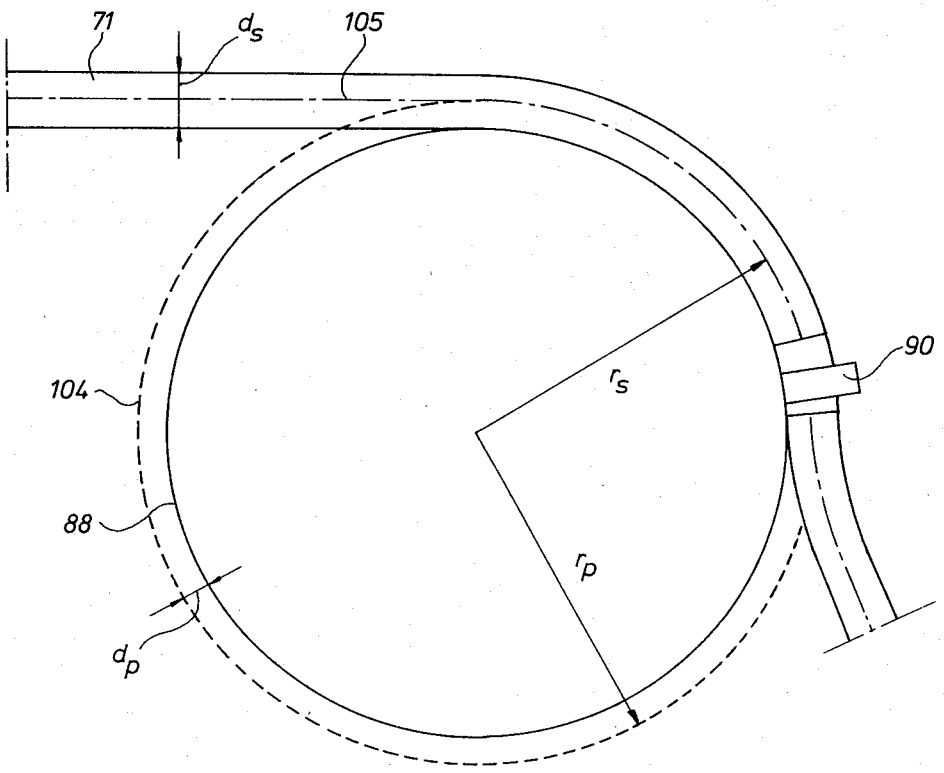

FIG. 10 illustrates on an enlarged scale the position of the or central plane of the leaf spring.

Referring to FIG. 1 which shows a diagrammatic illustration of a lithographic platemaker, the apparatus is mounted within an elongated light-tight housing 10 that is provided at its frontside 11 with a rectangular, light-tightly closable panel 12 that permits to an operator to fit a paste-up to be reproduced onto a pivotable paste-up holder 13. The holder 13 is preferably fitted with an underpressure system, so that by atmospheric pressure the paste-up may be urged into intimate contact with the flat supporting board of the holder. The holder may be swung about a horizontal pivot axis 14 into a vertical position 15 illustrated in broken lines. In that position the location of the paste-up is at the left-hand side of the holder according to the drawing, and the image of the paste-up may be projected by a lens 16 onto a photoconductor sheet 17 that is fitted to a sheet holder 18. The sheet 17 and the holder 18 have been illustrated in broken lines in the vertical position since they are pivotable about a pivot axis 19 into an almost horizontal position wherein the processing and the transfer of the toner image occur.

The illumination of a paste-up for exposure purposes may occur by means of lamp boxes such as 20 and 21. The lamp box 21 is arranged for pivotable movement out of the path of paste-up holder 13, in order to enable the free movements of the paste-up holder between its upper and lower position.

The photoconductor holder 18 forms part of a carriage comprising a chassis 22 to which the holder is pivoted. When the holder has been lowered onto the chassis, the chassis is moved along the substantially horizontal path indicated by the dash and dot line 23 that runs tangentially to a cylindrically curved sheet supporting member 24 onto which a receptor sheet in the form of an uncoated anodized aluminium plate may be fitted.

Aluminium plates of different formats are stored in bins such as 25, 26 and 27, and a plate transfer mechanism 28 that is pivotable at 29, is arranged to transport the desired plate to the member 24. In the case of smaller plate formats, the plates may be loaded in a bin as pairs of plates, and they may be fed to the drum in side by side relationship. A suitable device for gripping and lifting the plates in the mechanism 28 is disclosed in our co-pending European Application entitled: "An object holding device of sucker-cup type and sheet dispensing apparatus incorporating such device", filed on even day herewith.

The member 24, called hereinafter drum for the sake of simplicity, is provided with means for receiving the plate and for clamping it in a well-determined position on the periphery of the drum. A suitable construction for the drum that is capable of receiving different sheet formats and of tightly tensioning them on the drum, is disclosed in our co-pending European Application hereinbefore referred to.

The following processing stations are provided for the photoconductor sheet 17.

A corona discharge station 30 for the uniform charging of the photoconductor during its return movement from the previous cycle prior to the image-wise exposure.

A liquid toner developing station 31 wherein the electrostatic charge pattern that remains after the image-wise exposure, is developed, and wherein a reversely rotating roller 32 controls the thickness of the layer of remaining developing liquid. A suitable developing device for the present application is disclosed in our co-pending European Application No. 83 200 070.7 filed at the Jan. 19, 1983, and entitled: "Wet processing of the surface of moving sheets or webs".

A rinsing station 33 wherein the photoconductor surface is rinsed with a toner-free liquid, such as isododecane, thereby to clear the background of the image, and wherein a reversely rotating roller 34 controls the thickness of the remaining rinsing liquid layer.

A cleaning station 35 with rotatable resilient cleaning rollers 36 and scraper blades for cleaning the photoconductor during its return movement. The station may be vertically raised over some centimeters, by means of a lift mechanism represented diagrammatically by the cylinder 110, which is operative only during the return movement of the carriage.

A reconditioning station 37 wherein flooding with light prepares the photoconductor during its return movement for the next imaging cyle.

A toner transfer station, indicated by a circle 38 in broken lines, wherein by the application of a suitable potential difference between the photoconductor and the aluminium plate on the drum 24, the toner image pattern is progressively transferred onto the aluminium receptor plate during the tangential movement of the photoconductor past such plate.

A drying station 39 and a fixing station 40 for treating the aluminium plate after it has been removed from the drum 24, and transferred to the exit of the apparatus. The fixing station 40 may be arranged for pivotable movement at 111, so that it may be swung into a horizontal position preparatory to the discharging of the printing plate from the apparatus.

It will be understood that the apparatus comprises a great plurality of other facilities such as electrical and electronic control means, liquid supply means as diagrammatically illustrated by the numeral 109, pumps, fitters, safety features, etc. All these facilities belong to the state of the art and they require no further description herein.

Referring to FIG. 2, the holder 18 is provided at its upper side with two bearing blocks 43 and 44 whereby the holder is pivotally journalled on a shaft 45 that is fitted in a rectangular rigid frame 46. The frame 46 constitutes the chassis part of the carriage 22. This carriage is guided by rails 47 and 48 provided on top of vertical supports 49 and 50 (see FIG. 3). The frame is provided at the four corners with brackets 51 through 54 on which twin air-bearing heads such as 55 and 56 and single air-bearing heads such as 57 and 58 are provided. The use of air bearings for supporting a travelling carriage in a friction-free manner is known per se. The bearings are self-adjustable whereby they may readily align themselves with the bearing surfaces of the rails. The rail 47 has a V-shaped form, thereby to ensure the positive lateral guidance as well as the vertical support of the carriage. The rail 48 has a horizontal supporting surface and therefore affords only vertical support for the carriage. The air-bearings are connected via flexible hoses, not shown, to an air-pressure supply. The holder 18 is provided with means, not illustrated, for lifting the holder in the vertical position shown in FIG. 1, and for ensuring that when the holder is in the lowered position it is exactly parallel with the rails 47 and 48.

The driving of the carriage occurs by means of a belt 60, see FIG. 4, that runs over two pulleys 61 and 62 and has its ends attached to brackets 63 and 64 (see FIG. 2) that extend from a beam 65 fitted to the carriage by means of a separator or spacer beam 66. One end of the belt is connected to bracket 64 by a swrew-adjustment device 67 for adjusting the belt tension. A pulley 68 is fitted on the shaft of the pulley 62, see FIG. 2, and is driven from a motor 69 with inbuilt reduction gearing by a belt 70. The smooth driving of the carriage is promoted by the use of flat driving belts and flat rimmed pulleys. The beam 65 of the carriage is provided at its bottom side with a leaf spring 71 (see FIG. 4), one extremity of which is fitted to the beam at 72 and the free extremity of which extends beyond the beam 65 and has an upwardly deflected portion 73. The leaf spring is provided at a point adjacent to the deflected portion 73 with an opening 74 (see FIGS. 5 and 6) defined by a semi-circular end edge portion 75, two parallel side edge portions 76 and 77, and a V-shaped front edge portion 78.

Over about two thirds of its length the leaf spring is held against the bottom of the beam 65 by magnets 79 that are incorporated in the beam. The unsupported one-third length of the spring sags under gravity into approximately the position which is shown in FIG. 4. THe magnets may be ceramic magnets or the like that are mounted in suitable bores of the beam 65 and that lie flush with the lower surface of the beam. The spring is shown spaced from the beam merely to clarify the drawing.

The drum 24 is illustrated diagrammatically, see FIG. 2, and comprises a series of fingers such as 80 for gripping the leading margin of an aluminium plate 81 onto which a planographic printing image is to be formed using the transferred toner image. The drum comprises a similar series of grippers for engaging the trailing end of the plate.

The drum is mounted on a shaft 82 that is journalled in bearings 83 and 84 for free rotation. The driving of the drum occurs by means of a driving wheel 85 keyed to the shaft 82 and driven via a belt 86 by a motor 87 (see FIG. 4).

A disc 88 that is keyed to the extremity of the shaft 82 serves for the synchronization of the speed of the photoconductive sheet 17 and of the aluminium plate 81 during the transfer of the toner image. The disc 88 has a diameter that is equal to the diameter of the drum 24. Moreover the peripheral surfaces of the disc and drum have exactly matching profile. This identity can be achieved by carrying out the last machining steps, such as turning and grinding, of the drum and disc while both members are mounted on a common axis.

The disc 88 is provided with a pin 90 that is fitted radially in the disc, and that has an exposed length or projection of approximately 10 mm. The pin has been illustrated in broken lines in FIG. 6. The disc is further provided with indicators, such as the marker 91, see FIG. 7, that may be of optic or magnetic nature, and that co-operate with corresponding sensors, such as the sensor 92, fixedly mounted at different angular positions, and that may control the different angular positions. The markers and sensors form part of a control system (hereafter described) for controlling the rotary movements of the drum during the operation of the apparatus. The carriage 22 is provided with a marker 93 that co-operates with a plurality of sensors such as 94 and 95, see FIG. 8, for controlling the different positions and movements of the carriage, likewise through a control system.

The operation of the apparatus is described hereinafter with reference to FIGS. 1 and 4 to 9, FIG. 9 being a block diagram of the electronic control of the driving motors 69,87. Both motors are tacho-controlled D.C. motors in the present embodiment, but it will be understood that other types of motors can be used.

Referring to FIGS. 1, 4 and 9, the carriage is in the start position, the image-wise exposure of the photoconductor having taken place and the holder 18 having been lowerd into its horizontal position. The carriage starts to travel at a uniform rate towards the drum through the successive processing stations. In the developing station 31, the electrostatic charge pattern of the photoconductor is developed by the contact with the liquid toner at the top of the developing station. The thickness of the liquid toner layer deposited on the photoconductor according to the charge pattern is reduced to some tens of micrometers by the thickness control roller 32. The developed charge image is then rinsed in the rinsing station 33. During the described movement of the carriage an aluminium plate of the appropriate size is taken up by the drum and the drum has moved to a rest position in which the leading edge of the aluminium plate is at the top point of the drum. The drum is arrested in that position by signals delivered by the sensor 92 when it senses the presence of the marker 91, which signals cause the controller 96 to stop the rotation of the motor 87 driving the drum. In that position of the drum, the pin 90 on the disc 88 is in its uppermost position shown in FIG. 4.

As the carriage 22 closely approaches the drum, the free end of the leaf spring 71 contacts the pin 90 and becomes lifted thereby. The forward movement of the carriage continues until the opening 74 in the leaf spring arrives over and drops around the pin. The position of the pin 90 may then be about half-way along the length of the opening 74, but this position is not critical at all. At the moment the spring opening engages the pin, the marker 93 of the carriage 22 reaches the sensor 94, see FIG. 7, whereupon the sensor produces a signal to cause the controller 97 to switch off current to the motor 69. At the same time the controller causes a resistor to be connected in parallel with the rotor of motor 69 so that during subsequent movement of the carriage 22 by mechanical force as hereafter described, the motor operates as a brake. The actuation of the sensor 94 by the carriage 22 also serves through the connection 98 to cause the controller 96 to restart the driving of the drum motor 87. After slight rotation of the drum 24 through some arcminutes only, the pin 90 of the disc 88 engages the V-shaped front edge of the opening 74 in the leaf spring 71, so that further rotation of the drum causes the accompanying advance of the carriage 22. The application of a suitable potential difference between the photoconductor supported by the carriage, and the aluminium plate, causes the toner image progressively to transfer from the photoconductor to the aluminium plate, as these members progressively travel through the transfer zone 38.

The winding of the leaf spring 71 about the periphery of the disc 88 occurs extremely smoothly, without any vibration, so that the carriage 22, which is floatingly supported by the air-bearings on the rails and is slightly braked by the motor 69 that operates as a generator dissipating its energy in a resistance across its rotor, follows each increment of motion of the periphery of disc 88, and thus also of the drum 24, in a perfectly reproducable way. If the peripheries of the disc 88 and the drum 24 should show any local deviation from a truly circular, or cylindrical form, there will occur a corresponding small disparity between the speed of the photoconductor sheet displaced by the carriage, and the speed of the aluminium plate supported on the drum. While such a disparity may cause a very slight unsharpness or disturbance of the transferred image at the corresponding zone, it will be understood that in subsequent cycles of the apparatus such disparity will always occur at the same place because it is determined by characteristics of the disc and/or drum. This feature is notably important in color reproduction, since if several color separation printing plates are made on the apparatus, they will all "deviate" in the same way so that a generally sharply defined colour reproduction can be produced by printing the colour separation plate images in registration.

It is a further advantage of the V-shape of the leading end of the opening 74 that during pulling of the carriage 22 by the disc 88 the tensioning of the leaf spring maintains two-point contact of the spring with the driving pin 90 throughout the transfer operation so that the position of the spring relative to the disc is absolutely fixed.

When the carriage reached the position shown in FIG. 8, the marker 93 induces a signal in the sensor 95 whereby a controller 97 (FIG. 9) is actuated to cease the braking of the motor 69 and to energise that motor very briefly at a speed that is higher than the peripheral speed of the disc 88. This releases the tensioning of the spring 76 about the disc 88 so that the leading end of the leaf spring springs from the pin 90 and becomes caught by the magnets 79 in the beam 65. A further sensor such as 98 causes the controller 97 to reverse the movement of the carriage at the end of its course. The carriage returns at a uniform speed towards its initial rest position, for re-exposure of the photoconductor sheet.

If, for one reason or another, the above mentioned temporary overdrive movement of the carriage should fail to disengage the leaf spring from pin 90, a fixed deflector 99 (FIG. 8) causes such disengagement.

During the return motion of the carriage to its initial rest position, the drum continues to rotate, and it starts a second revolution where after some 30 angular degrees from the commencement of a second revolution, the leading edge of the aluminium plate is released at a position 100 (see FIG. 1). The plate is transported by means, not illustrated, along a path 101 past the drying station 39 where the developer liquid is evaporated, and the fixing station 40 where the toner image is fused into the printing surface of the aluminium plate. The plate is then ready for removal from the apparatus and for an occasional treatment with a liquid lithographic preparation containing a compound enhancing the ink and/or lacquer receptivity of the toner image, and containing further a compound increasing the ink-repelling characteristics of the plate surface.

After the plate has left the drum 24, the drum continues to rotate until at a plate loading position, indicated at 102, the leading edge of a new plate is fed by the mechanism 28 to the drum. During further rotation of the drum to accept the new plate, the carriage with the photoconductor is returned to its position at the left-hand side of FIG. 1. During this return movement, the light source 37 is energized to uniformly expose the photoconductor, and the cleaning station 35 is made operative by raising it by the cylinder 110, thereby to contact and clean the photoconductor during its return motion and flush away some remaining toner particles.

The following data illustrate a specific example of an apparatus as described and illustrated:

size of photoconductor sheet: 915×635 mm
type of photoconductor sheet: a polymeric support provided with an electrically conductive layer and a layer of an anorganic photoconductor
aluminium plate formats:
280×461 mm
396×576 mm
627×915 mm
diameter of the drum: 560 mm
peripheral speed of the drum 24 at the toner image transfer station: 0.1 $m.sec^{-1}$
maximum angle of wrap of leaf spring about the drum: 120 degrees
size of leaf spring:
length: 800 mm
width: 13 mm
thickness: 0.7 mm.

In the above described embodiment of the apparatus the diameter of the disc 88 is equal to the diameter of the drum 24. If in such case the thickness of the aluminium printing plate on the drum is equal to half the thickness of the leaf spring, then the peripheral speed of the surface of the aluminium plate is perfectly equal to the linear speed of the photoconductor. This is explained in detail hereinafter with reference to FIG. 10.

FIG. 10 is an enlarged view showing leaf spring 71 wrapped about the driving disc 88. The drum 24 on which the aluminium plate is tensioned has the same diameter as the disc and is therefore invisible in the drawing. The surface of revolution (having a radius $r_p$) of the free surface of the aluminium plate is 104. The thickness of the plate is thus $d_p$. The neutral plane of the leaf spring is indicated by the dash-and-dot line 105, and is situated at half the thickness $d_s$ of the leaf spring. The pitch circle of the wrapping of the spring about the disc therefore has a radius $r_s$. It will be understood that if $r_s=r_p$ the speed of the toner-receiving surface of the aluminium plate, is equal to the speed of the toner transferring surface of the photoconductor that moves tangentially to the drum. The condition $r_s=r_p$ is fulfilled for $d_p=0.5\ d_s$. In the described example the thickness of the aluminium plate amounted to 0.35 mm and the thickness of the spring was 0.7 mm.

Very small differences between $r_s$ and $r_p$ can be tolerated because their affect on the transfer image quality will be imperceptible.

The invention is not limited to the described embodiment of the apparatus.

The disc 88 may be replaced by a sector element the angular extent of which is sufficiently large for accomodating the leaf spring 71. The boundaries of such sector element may e.g. be situated as indicated by the broken lines 106 and 107 in FIG. 8. The disc 88 may be omitted in case the leaf spring is directly wound onto the cylindrical member that supports the aluminium plate.

The flexible pulling means may be in the form of a band of fabric or the like. The disengagement of the band from the drum may occur by slidably mounting the pin 90 and causing said pin to be withdrawn to become flush with the periphery of the disc 88, at the end of the toner transfer. The carriage may be supported by slide bearings, ball sleeve bearings, or the like.

The holder that supports the photoconductor sheet 17 may be arranged in the carriage for vertical displacement instead of or in addition to, the pivotal displacement about pivot 19. By such displacement the holder can be located so that the photoconductor sheet held thereby travels slightly below the mathematical tangent to the path of the receptor sheet surface and spacing members can be provided on the sheet holder, on the photoconductor sheet itself, or on the drum, which spacing members cause the photoconductor sheet to become vertically lifted and thereby accurately spaced from the receptor sheet surface as the photoconductor sheet enters the toner image transfer zone. Such an arrangement is disclosed in our co-pending European Patent Application entitled: "Apparatus for transferring electrophotographic images", filed on even date herewith.

The exposure of the photoconductor sheet need not necessarily be an integral, i.e., single, exposure as in the above specific embodiment. The exposure may occur linewise, for instance by scanning the charged photoconductor sheet as it starts to travel along the path 23, by means of a modulated laser beam, or by exposing the sheet to an elongated exposure head comprising one or more lines of light-emitting diodes (LEDs) mounted just upstream of the developing station 31. In this way, signals representing textual matter or pictorial images can be electronically generated, permitting gradation control, character control, image reversal, etc.

The direction of movement of the carriage during the image transfer may be opposite to the direction in which the carriage moves through the processing stations 31,33 etc. This arrangement requires the carriage to be displaced past the drum to the right hand side thereof as situated in FIG. 1, while there is no electric field at the image-transfer station, and then to be pulled back through that station by the drum during anticlockwise rotation thereof for effecting the image transfer. For this purpose the flexible tie would have to be at the left-hand end of the carriage.

I claim:

1. Apparatus for use in transferring a xerographic toner image from the surface of a first element to the surface of a second element, said apparatus comprising a rotatable member having a cylindrically curved periphery for supporting one element in cylindrically curved condition, concentric with the axis of rotation of said rotatable member, a carriage for holding another element, in the form of a sheet, a track for guiding said carriage substantially tangentially to the path of motion of said curved periphery of said rotatable member at an image transfer station, at which station there is means for forming an electrical potential gradient for effecting such toner image transfer, and driving means for rotating said rotatable member and causing a displacement of said carriage past said image transfer station, characterised in that said carriage displacement takes place in dependence of a traction force transmitted to said carriage by a flexible tie member one end of which is connected to said carriage and the other end of which is attached to said rotatable member in the vicinity of a cylindrically curved surface thereof so that said tie member becomes wound onto such surface by the rotation of said rotatable member, such surface having a radius of curvature such that the carriage is pulled past the transfer station at a speed substantially equal to that of such periphery of said rotatable member.

2. Apparatus according to claim 1, wherein said tie member is detachable from said rotatable member, and there is carriage driving means by which said carriage can be driven along said track preparatory to being coupled to the rotatable member by said tie member means.

3. Apparatus according to claim 2, wherein there is means for exerting a braking action on the carriage while it is being pulled past the transfer station by the tie member.

4. Apparatus according to claim 2, wherein said flexible tie member and said rotatable member have coupling means by which they become automatically coupled when said carriage is brought by said carriage driving means to a predetermined position along said track, and there is control means which operates automatically to swith off said carriage driving means so that it is inoperative before the carriage reaches said transfer station.

5. Apparatus according to claim 4, wherein said tie member comprises an elongate leaf spring having coupling means in the form of an opening in an end portion thereof, which opening moves into engagement with a projection on said rotatable member when said carriage is brought to said predetermined position by said carriage driving means.

6. Apparatus according to claim 5, wherein an end portion of said leaf spring between its opening and its adjacent extremity, is inclined with respect to the line of motion of said carriage and as the carriage arrives at said predetermined position said spring end portion makes sliding contact with said projection and is thereby deflected until said projection can enter such opening.

7. Apparatus according to claim 6, wherein said projection is a pin having a cylindrically curved bearing surface and said opening has a V-shaped front boundary edge against which such curved pin surface bears when the carriage is being pulled by said tie member.

8. Apparatus according to claim 5, wherein in the uncoupled condition of said carriage a part of said leaf spring is held against said carriage by magnets and that spring part becomes pulled from said magnets during the winding of the tie member onto the rotatable member.

9. Apparatus according to claim 4, wherein after the carriage has been pulled past said transfer station by said flexible tie member the carriage driving means effects further displacement of the carriage in the same direction and at a faster speed, and such faster displacement effects uncoupling of said tie member from said rotatable member.

10. Apparatus according to claim 9, wherein a coupling release member is located near the surface of the rotatable member onto which said tie member winds and effects said uncoupling of the tie member in the event that it is not uncoupled by the faster displacement of said carriage.

11. Apparatus according to claim 4, wherein there is control means whereby rotation of said rotatable member is arrested, ready for attachment of said tie member, in a position in which its coupling means is at its closest to the tangential path of said carriage.

12. Apparatus according to claim 2, said apparatus forming part of a machine which includes means located for applying developing toner to a photoconductor sheet bearing an electrostatic latent image, while such sheet is held by said carriage and while such carriage is being displaced along said track by said carriage driving means.

13. Apparatus according to claim 1, wherein said carriage is supported by said track through the action of air bearings.

14. Apparatus according to any preceding claim, wherein said carriage track is located so that it can carry a sheet through said transfer station in a plane such that the sheet surface facing the rotatable member moves through said station at a small spacing from an element on the cylindrically curved periphery of said rotatable member.

15. Apparatus according to claim 1, wherein said rotatable member has means by which an element in the form of a flexible sheet can be held against its said cylindrically curved periphery.

16. Apparatus according to claim 15, when used for transferring a toner image from a photoconductor sheet mounted on said carriage, to the surface of a receptor sheet mounted on said rotatable member, the toner image bearing surface of said photoconductor sheet being moved through the transfer station out of contact with the surface of said receptor sheet.

17. Apparatus according to claim 16, wherein said receptor sheet is a lithographic aluminium printing plate.

* * * * *